United States Patent [19]

Jagdmann et al.

[11] 3,949,407

[45] Apr. 6, 1976

[54] DIRECT FED SPIRAL ANTENNA

[75] Inventors: Kenneth M. Jagdmann, Melbourne; Harry Richard Phelan, Indialantic, both of Fla.

[73] Assignee: Harris Corporation, Cleveland, Ohio

[22] Filed: Mar. 6, 1975

[21] Appl. No.: 555,796

[22] Filed: Mar. 6, 1975

[21] Appl. No.: 555,796

[52] U.S. Cl. ..... 343/895; 343/854

[51] Int. Cl.[2] ..... H01Q 1/36

[58] Field of Search ..... 343/854, 895

[56] References Cited

UNITED STATES PATENTS 3,039,099 6/1962 Chait et al. ..... 343/895

*Primary Examiner*—Eli Lieberman

[57] ABSTRACT

A direct fed spiral antenna element array is disclosed for radiating electromagnetic energy. Each antenna element is a multi-arm spiral element having inner and outer ends. Phase shifting is obtained with internal phase control wherein switching means serve to interconnect selected ones of the inner arm ends. Each such antenna element is directly fed by a feed network which feeds currents directly to the outer ends of the spiral arms.

10 Claims, 14 Drawing Figures

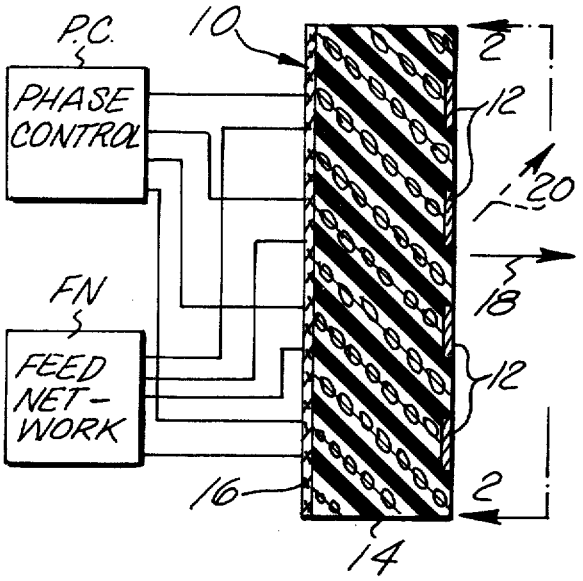
FIG. 1
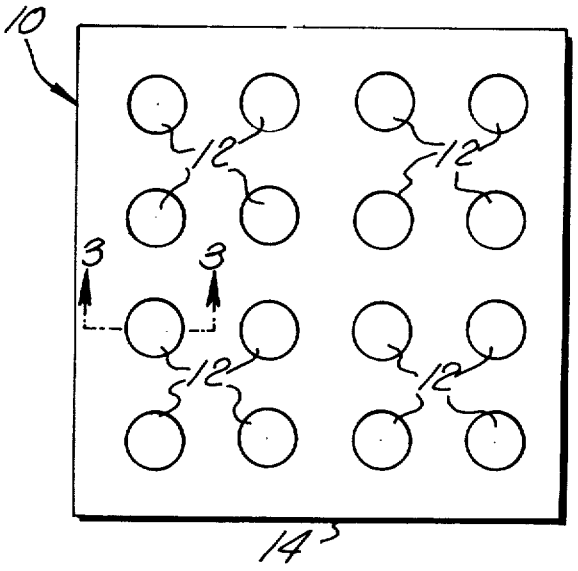
FIG. 2
FIG. 3
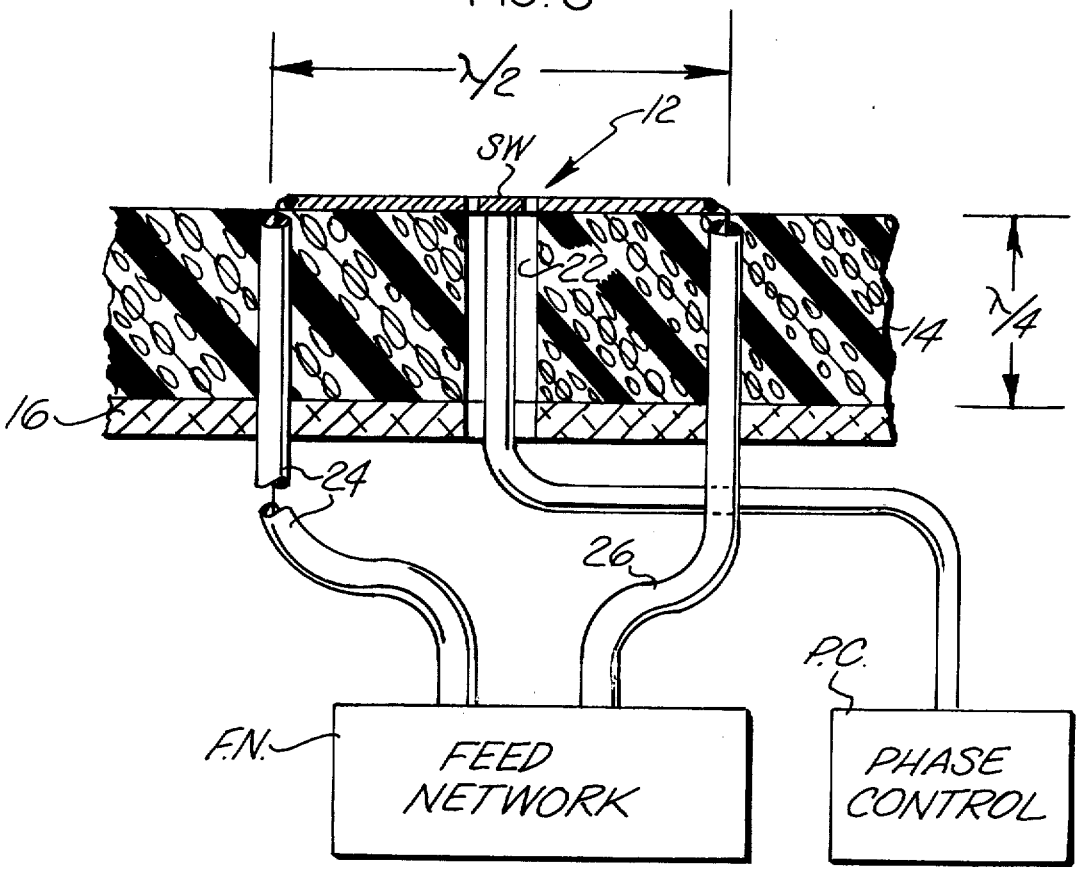

0° STATE

90° STATE

180° STATE

270° STATE

DIRECT FED SPIRAL ANTENNA

This invention relates to the art of antennas and, more particularly, to an improved direct fed antenna element particularly applicable for use in a phased array antenna system.

The element antenna is particularly applicable for use in a phased array wherein the individual antenna elements are directly fed from a radio frequency source for radiating electromagnetic energy.

The present invention is directed to a system wherein each antenna element preferably takes the form of multiple spiral arms having inner and outer ends and wherein radio frequency energy is directly fed to the outer ends in a phase relationship such that as current flows inwardly toward the inner ends efficient radiation cannot take place until the current is either reflected back from the inner arm ends or current is swapped between the arms by a selected interconnection of inner arm ends to achieve desired phase control.

The present invention is directed toward improvements over those disclosed in H. R. Phelan's pending U.S. Pat. application Ser. No. 440,182, filed Feb. 6, 1974. That application discloses various antenna arrays of internally phased elements wherein each element is disclosed as including multiple spiral arms. The arrays illustrated there are reflectarrays and, hence, are fed from a space source. Phase control of reradiated energy is accomplished by interconnecting selected inner arm ends. The present invention contemplates use of arrays similar to that disclosed in that application but wherein the space feed is replaced by a direct feed to the antenna element and wherein the feed is applied only to the outer arm ends.

It has been known in the art to directly feed a multiple arm spiral antenna element. Conventionally, such antenna elements are fed at the inner arm ends and not at the outer arm ends. This, for example, is discussed in the patent to H. N. Chait et al. U.S. Pat. No. 3,039,099. As discussed in that patent when a two-arm spiral antenna element has its inner arm ends fed with antiphase currents, currents will flow outwardly and gradually become in-phase at a place, called the active region, where the radius is equal to $\lambda/2\pi$. During this condition efficient radiation takes place. Feeding such an antenna element at the outer arm ends with antiphase energy may result in efficient radiation as the currents flow inwardly and reach the active zone i.e. where the radius is equal to $\lambda/2\pi$.

The Phelan application discussed above does not disclose apparatus for directly feeding the antenna element but instead the antenna elements are employed in a reflectarray and receive energy from a space source. If one were to provide a direct feed to the antenna elements, then the conventional approach, as noted in the Chait et al. patent, would be to apply the feed to the inner arm ends. If the inner arm ends are open circuited as they are in the Chait patent then no adverse operation ensues. However, if the inner arm ends are short circuited to obtain phase control as discussed in the Phelan application then the short would cause applied power to be reflected back to the power source, resulting in no radiation being obtained. Moreover, if the outer arm ends are fed as in the manner proposed by the Chait patent, then radiation would occur as current initially flows inwardly and reaches the active zone. This would not permit phase control by means of current swapping between the inner arm ends by virtue of shorting bars or the like serving to selectively interconnect the arm ends.

It is a specific object of the present invention to provide an antenna element usuable in an array of such elements wherein each element includes multiple spiral arms which are directly fed from a radio frequency power source by applying the radio frequency power to the outer ends of the spiral arms and in such a manner that current must flow inwardly beyond the active zone and then be reflected from the inner arm ends or be swapped from arm to arm before re-entering the active zone to achieve efficient radiation in order to thereby obtain phase control of the radiated energy while also obtaining the energy from a direct feed.

It is a still further object of the present invention to profide such an antenna element as discussed which may be constructed with light weight components, such as printed circuits, permitting low cost construction in large volume.

It is a still further object of the present invention to provide such an antenna element as discussed above and which is small in size and exhibits a low weight characteristic which is obtained by integrating the phase shift function within the antenna element to thereby eliminate extraneous transmission lines and components which contribute to conventional phase shift or loss.

It is a still further object of the present invention to provide such an antenna element exhibiting a low element insertion loss, on the order of less than 1.0 db by incorporating the phase shift function within the array element.

It is a still further object of the present invention to provide such an antenna element which does not require space feed and phase shift bulk so as to thereby obtain an extremely thin array of such antenna elements such as an array thickness approximating ¼ wavelength.

The present invention contemplates an element antenna be constructed of a plurality of electrically conductive spiral arms which are spaced from each other and which have a common axis of rotation. Each arm has an inner and outer end and the inner ends of the arms are rotationally displaced about the axis relative to each other to achieve a given rotational phase progression about the common axis. Moreover, it is also contemplated that each such an element antenna be provided with phase control means which serves to effectively electrically rotate the spiral arms about the common axis to thereby control the phase relationship of electromagnetic energy that is radiated from the element antenna. The phase control includes interconnecting means, such as a shorting bar or a controllable switch such as a diode or transistor, for interconnecting at least one pair of the inner arm ends together such that electrical signals in the respective interconnected pair of arms may be interchanged from one arm to the other with a relative phase change dependent upon the rotational phase relationship between the interconnected inner arm ends.

In accordance with the present invention, radio frequency energy is directly fed to the outer arm ends on the antenna element such that current is caused to flow inwardly through each arm from the outer end and then beyond the active zone of the spiral antenna element to the inner end where the currents are either reflected or swapped from arm to arm if an interconnection be made and then the currents flow outwardly and then re-enter the active zone in-phase so as to achieve efficient radiation.

In accordance with a still further object of the present invention radio frequency energy is directly fed to the outer arm ends by transmission lines which are of equal lengths and impedance as they extend from the respective outer arm ends to the source of radio frequency energy.

DESCRIPTION OF PREFERRED EMBODIMENT

The foregoing and other objects and advantages of the invention will become more readily apparent from the following description of the preferred embodiment of the invention as taken in conjunction with the accompanying drawings, which are a part hereof and wherein:

FIG. 1 is an elevational view illustrating an array of spiral arm antenna elements which are directly fed from a source of radio frequency energy;

FIG. 2 is a side elevational view taking generally along line 2—2 looking in the direction of the arrows in FIG. 1 and illustrating one side of the array;

FIG. 3 is an enlarged sectional view taken generally along line 3—3 in FIG. 2 and looking in the direction of the arrows and illustrating a section of an element antenna;

Figure 4:
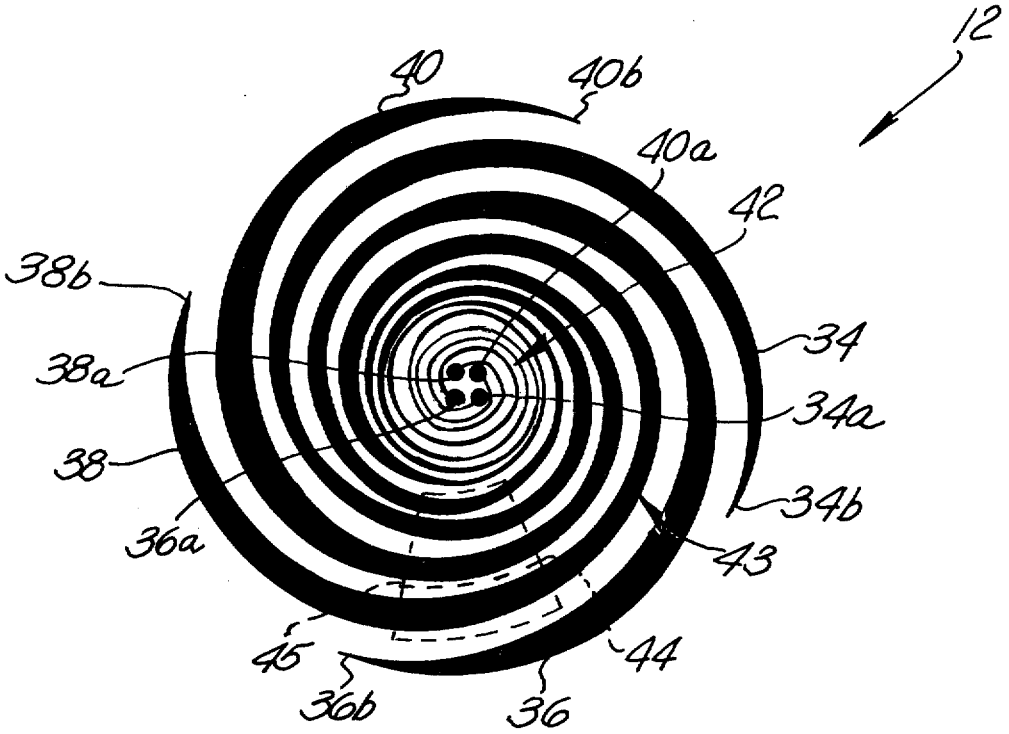
FIG. 4 is an enlarged view showing the construction of each element antenna.

Referring now to the drawings wherein the showings are for purposes of illustrating a preferred embodiment of the invention only and not for purposes of limiting same, there is illustrated in FIGS. 1, 2, and 3 a planar array 10. This array is comprised of a plurality of multi-spiral arm antenna elements 12 suitably mounted on a substrate 14 which may be constructed of electrically insulating material, such as plastic foam. A ground plane 16, which may be constructed from an aluminum plate, is suitably mounted on the plastic foam on the side opposite from the antenna elements 12. The antenna elements 12 are directly fed with radio frequency energy from a feed network FN so as to radiate electromagnetic energy in a forward direction, as indicated by the arrow 18. The radiated electromagnetic energy may be steered along a different direction, as indicated by the dotted arrow 20, under the control of a phase control switching network PC.

As is best shown in FIGS. 3 and 4 each antenna element 12 is preferably constructed as a four arm spiral antenna element wherein the arms of the element are substantially coplanar. The antenna elements 12 are spaced from the ground plane 16 by one quarter wave length. The spiral diameter as taken from the outer ends is on the order of one half a wave length. The arms of each antenna element 12 may be mounted on the plastic foam substrate 14 in any suitable manner, as by epoxy.

As is best shown in FIG. 3 an axial bore 22 may be provided for each antenna element to provide access for transmission lines from the phase control circuit PC to a switching circuit SW centrally located between the inner arm ends of the antenna element. This switching network will be described in greater detail hereinafter with reference to FIG. 6. Preferably, feed network FN incorporates a plurality of coaxial cables which serve to supply radio frequency energy to the outer arm ends of the antenna element. With respect to the two arms illustrated in FIG. 3, the feed network provides a pair of coaxial cables 24 and 26 of equal length and impedance from the feed network to the outer arm ends. This structure is described in greater detail hereinafter with respect to the schematic circuit diagrams illustrated in FIGS. 9 and 10.

Reference is now made to FIG. 4 which illustrates the construction of an antenna element, such as element 12. This is a spiral antenna element consisting of four spiral arms 34, 36, 38 and 40. The arms may be constructed by printed circuit techniques wherein the four individual arms are conductive copper strips mounted on the surface of a plastic substrate so that the arms are electrically insulated from each other. Each arm is comprised of a combination of an archimedean and logarithmic spiral portions. The inner archimedean portion, generally referred to by the character 42, of each arm extends from the innermost end of the arm and outwardly therefrom in an archimedean fashion and terminates into the outer logarithmic portion, generally referred to by the character 43, which continues outwardly until it terminates in an outer arm end. The inner arm ends are respectively designated as 34A, 36A, 38A, and 40A. The outer arm ends are respectively designated by the characters 34B, 36B, 38B, and 40B respectively.

In the example of FIG. 4, the antenna element is a left-hand element and the inner arm ends are rotationally displaced about a common axis relative to each other by 90° to thereby achieve a rotational phase progression of 0°, 90°, 180° and 270°. When the antenna element is performing its transmitting function, antenna excitation currents flowing from the inner arm ends to the outer arm ends are transmitted in spiral paths extending outwardly along the arms until they arrive at a place on the antenna which is suitable for radiating waves of the excitation frequency employed. This place or portion of the arm is called the active zone, whose position varies depending upon the frequency. This is an annular ring portion and a portion of the annular ring is indicated in FIG. 4 with reference to zone 44. This zone is but a portion of the annular ring essentially coaxial about the axis of rotation of the antenna element. The active zone is not sharply defined. Instead, the sensitivity of the antenna progressively increases with increasing radius and progressively decreases with further increasing radius and has a maximum sensitivity at some mean radius 45 within zone 44.

The circumference of the mean circle of the active zone is approximately one wavelength $\lambda$ of the wave being propagated along the arms. This wavelength is slightly smaller than a free space wavelength because the velocity of propagation on the arms is slightly smaller than the free space velocity. In the active zone, there is approximately a 360° phase shift standing on any arm of the spiral antenna around a complete loop of the spiral at one instance of time.

Since the structural phasing of the inner terminals 34A, 36A, 38A and 40A to the active zone is 0°, 90°, 180° and 270°, respectively, then in-phase currents applied to the inner arm ends will arrive at the active zone out of phase preventing efficient radiation. As will be brought out hereinafter, to achieve a 0° phase state, the currents supplied to the inner arm ends 34A, 36A, 38A and 40A should have a phase relationship of 0°, 270°, 180° and 90° respectively so that the resulting phase of the currents at the active region will be 0° on each arm. This will result in efficient radiation of electromagnetic energy. However, such an antenna element as discussed thus far will not provide, in an array of such elements, the ability to obtain phase control; namely the ability to direct energy along a particular direction such as path 20 in FIG. 1. Such a phase change can be effected by mechanically rotating the various antenna elements or by employing the phase control switching mechanism to be described hereinbelow with reference to FIGS. 5 and 6.

Figure 5:
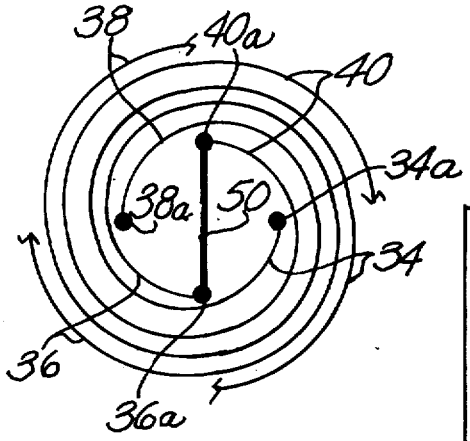
FIG. 5 is a schematic illustration of an element antenna having a shorting bar interconnecting a pair of the inner arm ends.

FIG. 5 illustrates one manner of obtaining phase control by effectively rotating the antenna element. Instead of obtaining the rotation by mechanical means an electrical rotation is obtained by interconnecting selected inner arm ends of the antenna element. As illustrated in FIG. 5, a conductive link or shorting bar 50 serves to connect inner arm ends 36A, and 40A. In practice this shorting bar may be a semiconductor, such as a switching diode or a transistor. Another shorting bar may be used to interconnect inner arm ends 34A and 38A. Or the inner arm ends may be selectively open circuited. In the example shown in FIG. 5 with only one shorting bar 50 serving to interconnect inner arm ends 36A and 40A phase changing occurs in the manner as discussed below.

The currents flowing inwardly along the spiral arms 34 and 38 reflect when they encounter the open circuited terminals 34A and 38A and cause current waves to start to propagate outward along the same spiral arms. The received current of arm 34 becomes, when it reaches the inner terminal 34A, the negative of the inwardly flowing current of the same arm. In the same way, the outwardly flowing current in arm 38 is simply the negative of the inwardly flowing current in the same arm. The current flowing inwardly along arm 40 is connected through the shorting bar 50 to the inner arm end 36A of arm 36 so that the inwardly flowing current in arm 40 becomes the transmitting current flowing outwardly in arm 36. Conversely, the inwardly flowing current on arm 36 becomes the outwardly flowing and transmitting current in arm 40. There is a current cross over between the two arms through the shorting bar 50, which can in practice be a switching diode or a transistor.

When the outward propagating wave arrives at the active zone of the antenna element it causes radiation if the currents in the arms are in phase. Reconnecting shorting bar 50 across inner arm ends 34A and 38A instead of between inner arm ends 36A and 40A would cause a different phase shift, different by 180° from its previous value.

The relative phases between the inward propagating currents when in the active zone and the outward propagating currents when they arrive back at the active zone is a function of the round trip distance from the active zone inward to the inner terminals and then back along the spiral arms, and can be expressed in wavelengths on the line. This phase difference can be altered by changing the connection at the inner terminals 34A, 36A, 38A and 40A as just described.

Figure 6:
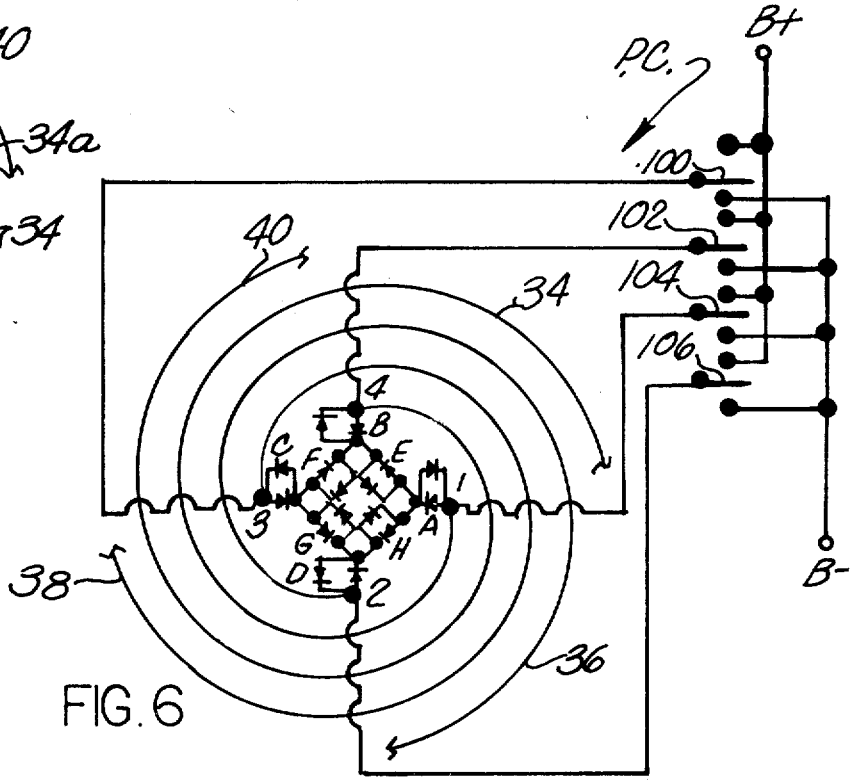
FIG. 6 is a schematic illustration of an element antenna illustrating a diode switching network for interconnecting selected inner arm ends under the control of selected switches.

Preferably the invention is practiced with the use of switching diodes rather than the shorting bar illustrated in FIG. 5. A diode switching circuit which may be employed takes the form, for example, as illustrated in FIG. 6. Here there is illustrated a four arm spiral antenna element with diodes connected to the inner arm ends. The inner arm ends are respectively labeled 1, 2, 3, and 4 and correspond with inner arm ends 34A, 36A, 38A, and 40A in the discussion given hereinbefore with reference to FIG. 5. A phase control switching network may take the form as shown including a plurality of single pole double throw switches 100, 102, 104, and 106 which serve to respectively apply DC bias voltages to the terminals 1, 2, 3, and 4 to effect diode switching operation. The connections achieved correspond with the use of shorting bars so as to provide either open circuit or short circuit connections.

In FIG. 6, when terminal 1 receives a positive voltage by having switch 104 in its upper position, and terminal 4 is given negative voltage by having switch 102 in its lower position, and terminals 1 and 3 have no bias voltage applied because switches 106 and 100 are in their neutral positions, the following diode pairs are conductive for small signals: A, B, E, F, G, H. Diodes sets C and D do not conduct. The relative phase of the group of transmitting currents for this condition can be arbitrarily a particularly phase state. By properly manipulating switches 100, 102, 104 and 106 various of the terminal inner arm ends 1, 2, 3, and 4 may be selectively shorted or open circuited.

Two phase conditions to be referred to hereinafter are condition "A" and condition "B" and they require different diode states; that is, the pattern of interconnecting terminals 1, 2, 3, and 4 of the antenna element illustrated in FIG. 6. These will be explained in greater detail hereinafter. However, reference is now made to FIGS. 7A and 7B which respectively illustrate the diode states or switching configurations to obtain a 0° phase state or a 180° phase state for phase condition A. That is, for condition A a 0° phase state is obtained by an open circuit condition whereas a 180° phase state is obtained when the diodes are biased so as to effectively short terminals 1 and 3 together and to short terminals 2 and 4 together. Similarly, for phase condition B the switching configurations to obtain a 0° phase state, a 90° phase state, a 180° phase state, and a 270° phase state are illustrated in FIGS. 8A, 8B, 8C, and 8D respectively.

Figure 7A:
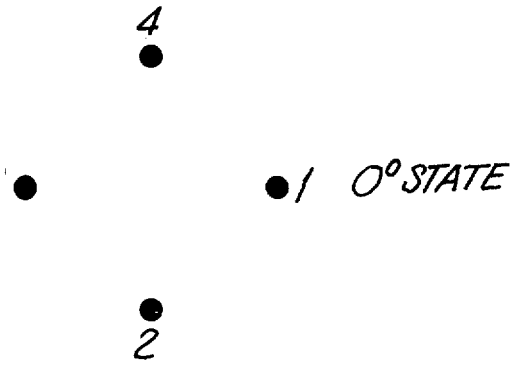
FIGS. 7A and 7B are graphical illustrations of switching configurations.
Figure 7B:
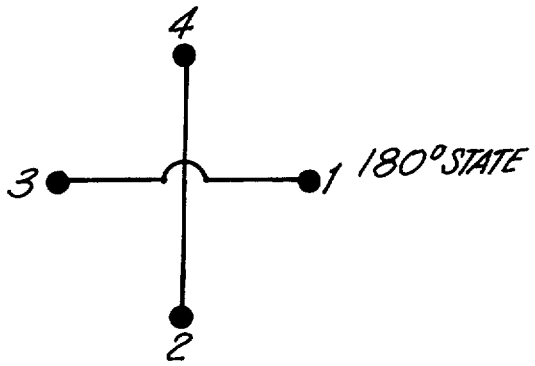

Phase conditions A and B require the switching configuration illustrated in FIGS. 7 and 8 and respectively permit one bit and two bit operations. A one bit operation as evidence by FIG. 7A and 7B, provides two phase states, whereas a two bit operation, as evidence by FIGS. 8A through 8D, provides four phase states. These different phase states permit beam steering so that, for example, the radiated wave may be selectively steered along the direction 18 (see FIG. 1) or off axis such as that along the direction 20. Consequently then, when an array of antenna elements are employed it is desirable to provide such phase control to achieve beam steering. Other than the 0° phase state for the one bit phase shift operation for condition A (See FIG. 7A) the other phase state conditions require that there be a short circuit between at least two inner arm ends of an element antenna.

If a direct feed (as opposed to a space from feed) be supplied to an element antenna at the inner arm ends then problems will arise in any phase state which requires at least two inner arm ends to be short circuited, as by a shorting bar or by a switching diode. Thus, for example, with respect to the 0° phase state illustrated in FIG. 8A, inner arm ends 2 and 3 must be short circuited together. If the feed to these inner arm ends is supplied directly to the inner arm ends rather than the outer arm ends, then current will immediately be reflected back ffrom the shorted connection to the feed source, preventing radiation of electromagnetic energy. On the other hand, if the feed be directly to the outer arm ends, then care must be taken to prevent radiation as the initial inward flow of current reaches the active zone before the currents have had an opportunity to reach the inner switching connections. This may permit energy to be radiated, however, it would not permit phase control by having the currents interchange from one antenna arm to another through the interconnected inner arm ends.

In accordance with the present invention then, the feed is supplied directly to the outer arm ends of element antenna as illustrated in FIG. 3. But the input excitation is such that as the currents arrive at the spiral active region (at a diameter equal approximately $\lambda/\pi$) they are out of phase so that no radiation occurs. Thus, the currents will continue to flow inwardly to the center terminals where they are reflected or the currents in selected arms interchange through short circuits. Care must be taken so that as the currents flow outwardly they will re-enter the active region with the currents being in phase to achieve efficient radiation.

Consequently then, as the inwardly flowing currents arrive at the active region they must be out of phase to prevent radiation. One phase condition that satisfies this requirement is that the currents initially enter the active region with a phase progression of 0°, 180°, 0°, and 180° on arms 34, 36, 38, and 40 respectively. Such an out of phase condition will prevent radiation and this condition is referred to herein as condition A. Another phase condition, condition B, that satisfies this requirement is for the currents to flow inwardly and arrive at the active region with a phase progression of 0°, 0°, and 180° on arms 34, 36, 38, and 40 respectively.

In order to achieve condition A or condition B, the correct relative phasing of the input currents must be determined. As was brought out hereinbefore, the arms 34, 36, 38, and 40 have a relative phase progression of 0°, 90°, 180°, and 270° respectively. Consequently then, if the currents supplied to the outer arm ends are all in phase, then without more, they will arive at the active zone having a phase progression of 0°, 90°, 180°, and 270°. This phase progression may be referred to as the insertion phase for the antenna element. The correct phasing to achieve condition A or achieve condition B may be obtained by adding the desired phase condition A to the insertion phase or the desired phase condition B to the insertion phase. This will then provide the required spiral end phase excitation to achieve condition A or condition B. The required spiral end phase excitation to achieve condition A is 0°, 270°, 180°, and 90° relative phase for the feed currents supplied to outer arm ends 34B, 36B, 38B, and 40B respectively. Using the same type of calculation, the required excitation for condition B (0°, 0°, 180°, and 180°) is 0°, 90°, 0°, and 90° phase relationship of the currents supplied to the outer arm ends 34B, 36B, 38B, and 40B respectively.

Figure 9:
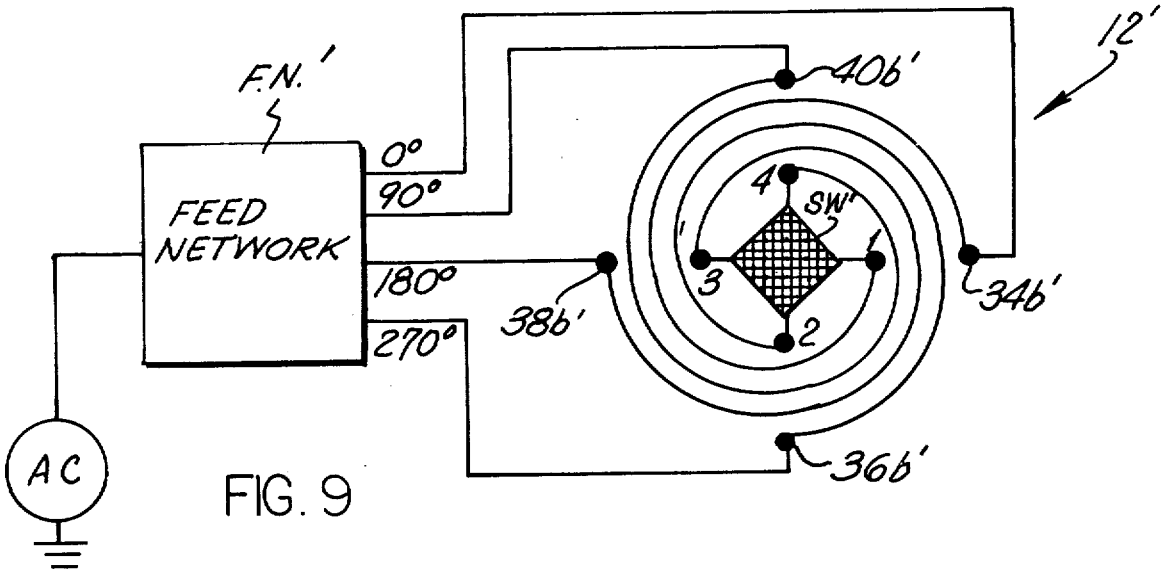
FIG. 9 is a schematic illustration showing a directly fed antenna element together with a feed source; and, FIG. 10 is a schematic illustration showing a pair of directly fed antenna elements together with a feed source.

Reference is now made to FIG. 9 which illustrates an antenna element operable in the one bit mode, (two phase states 0° and 180°) in accordance with the phase condition A. Here the feed network FN′ is constructed from conventional circuitry and serves to supply radio frequency energy to the outer arm ends 34B′, 36B′, 38B′, and 40B′ of an element antenna corresponding essentially with that discussed hereinbefore with reference to FIGS. 4 and 5. The inner arm ends are respectively labeled 1, 2, 3, and 4 to correspond with the terminal points illustrated in FIG. 7A and 7B for a phase condition A mode. A switching network SW′ is schematically illustrated as being interconnected with the inner arm ends 1, 2, 3, and 4 and may be comprised of either shorting bars or switching diodes as discussed hereinbefore. If the switching network take the form of switching diodes then the diodes may be selectively biased on or off in accordance with the phase control switching circuit illustrated in FIG. 6. Since this embodiment illustrates the condition A phase mode of operation, the feed network FN′ feeds radio frequency energy to the outer arm ends with the phase progression of 0°, 270°, 180°, and 90° on arm ends 34B′, 36B′, 38B′, and 40B′ respectively. This then is the required spiral in-phase excitation for a phase A mode of operation. To obtain a 0° phase state, the switching configuration will be arranged to achieve a total open circuit condition as indicated by FIG. 7A. For a 180° phase state the switching configuration will be arranged to obtain short circuit between inner terminals 1 and 3 and between terminals 2 and 4 as is indicated in FIG. 7B.

For a phase condition A mode with a 0° phase shift operation the inner arm end terminals 1, 2, 3, and 4 will be in an open circuit condition. The operation which ensues to obtain operation such that the currents flow inwardly to the end terminals and then outwardly and arrive at the active region in an in-phase condition to obtain 0° relative phase shift will now be explained with reference to FIG. 7A, FIG. 9 and Table I reproduced below.

TABLE I

PHASE CONDITION "A"
0 DEGREES PHASE SHIFT

| CURRENT STATE/ INSERTION PHASE | CURRENT FLOW | RELATIVE PHASES OF WINDINGS 1 | 2 | 3 | 4 |
|---|---|---|---|---|---|
| 1. Current applied to outer arm ends | In | 0° | 270° | 180° | 90° |
| 2. Insertion phase to active region | In | 0° | 90° | 180° | 270° |
| 3. Currents arrive at active region | In | 0° | 180° | 0° | 180° |
| 4. Insertion phase to inner arm ends | In | 0° | 90° | 180° | 270° |
| 5. Currents arrive at inner arm ends | In | 0° | 270° | 180° | 90° |
| 6. Insertion phase to active region | Out | 0° | 90° | 180° | 270° |
| 7. Currents arrive at active region | Out | 0° | 0° | 0° | 0° |

The feed network FN′ applies radio frequency energy to the outer arm ends 34B′, 36B′, 38B′, and 40B′

(referred to as windings 1, 2, 3, and 4 respectively in Table I) with a relative phase progression of 0°, 270°, 180°, and 90° respectively. Thus, current will flow inwardly toward the active region. As will be recalled from the previous discussion, the insertion phase to the active region from the outer arm ends is 0°, 90°, 180°, and 270° on windings 1, 2, 3, and 4 respectively. Consequently then, the inwardly flowing current will arrive at the active zone with the relative phase progression of 0°, 180°, 0° and 180°. This out of phase condition will prevent efficient radiation of electromagnetic energy. Current will now continue to flow from the active region toward the inner arm ends (terminals 1, 2, 3, and 4). The insertion phase from the active zone to the inner arm ends is 0°, 90°, 180°, and 270° for windings 1, 2, 3, and 4 respectively. Consequently then, the currents will arrive at the inner arm ends 1, 2, 3, and 4 with a phase progression of 0°, 270°, 180°, and 90° respectively. Since in this condition the switching configuration serves to provide an open circuit condition there will be no current swapping between the respective arms. The currents will have the same relative phase progression as they commence to flow outwardly. However, the insertion phase from the inner arm ends to the active region is 0°, 90°, 180°, and 270° respectively. This means then that the current will reach the active zone in an in-phase condition with a relative phase progression of 0°, 0°, 0°, 0° respectively. Consequently then, the currents will arrive in-phase and efficient radiation will take place.

When the switching configuration for a phase "A" condition results in short circuits between terminals 1 and 3 and between terminals 2 and 4 as indicated in FIG. 7A the operation that ensues follows that tabulated in Table II below.

TABLE II

| PHASE CONDITION "A" 180 DEGREES PHASE SHIFT | | | | | |
|---|---|---|---|---|---|
| CURRENT STATE/ INSERTION PHASE | CURRENT FLOW | RELATIVE PHASES OF WINDINGS 1 | 2 | 3 | 4 |
| 1. Current applied to outer arm ends | In | 0° | 270° | 180° | 90° |
| 2. Insertion phase to active region | In | 0° | 90° | 180° | 270° |
| 3. Currents arrive at active region | In | 0° | 180° | 0° | 180° |
| 4. Insertion phase to inner arm ends | In | 0° | 90° | 180° | 270° |
| 5. Currents arrive at inner arm ends | In | 0° | 270° | 180° | 90° |
| 6. Current interchange | Out | 180° | 90° | 0° | 270° |
| 7. Insertion phase to active region | Out | 0° | 90° | 180° | 270° |
| 8. Currents arrive at active region | Out | 180° | 180° | 180° | 180° |

From an examination of Table II it will be noted that the first five steps corresponding with the first five steps shown in Table I. However, because of the short circuits to obtain a 180° phase state operation the currents will interchange between terminals 1 and 3 and terminals 2 and 4. Consequently then, the currents will initially commence flowing outwardly with a relative phase progression of 180°, 90°, 0°, and 270° on windings 1, 2, 3, and 4 respectively. The insertion phase from the inner arm ends to the active region is 0°, 90°, 180°, and 270° and the currents arrive at the active region on the respective arms with a relative phase of 180°, 180°, 180°, and 180°. Thus, the currents arrive at the active zone in-phase, resulting in efficient radiation.

Figure 10:
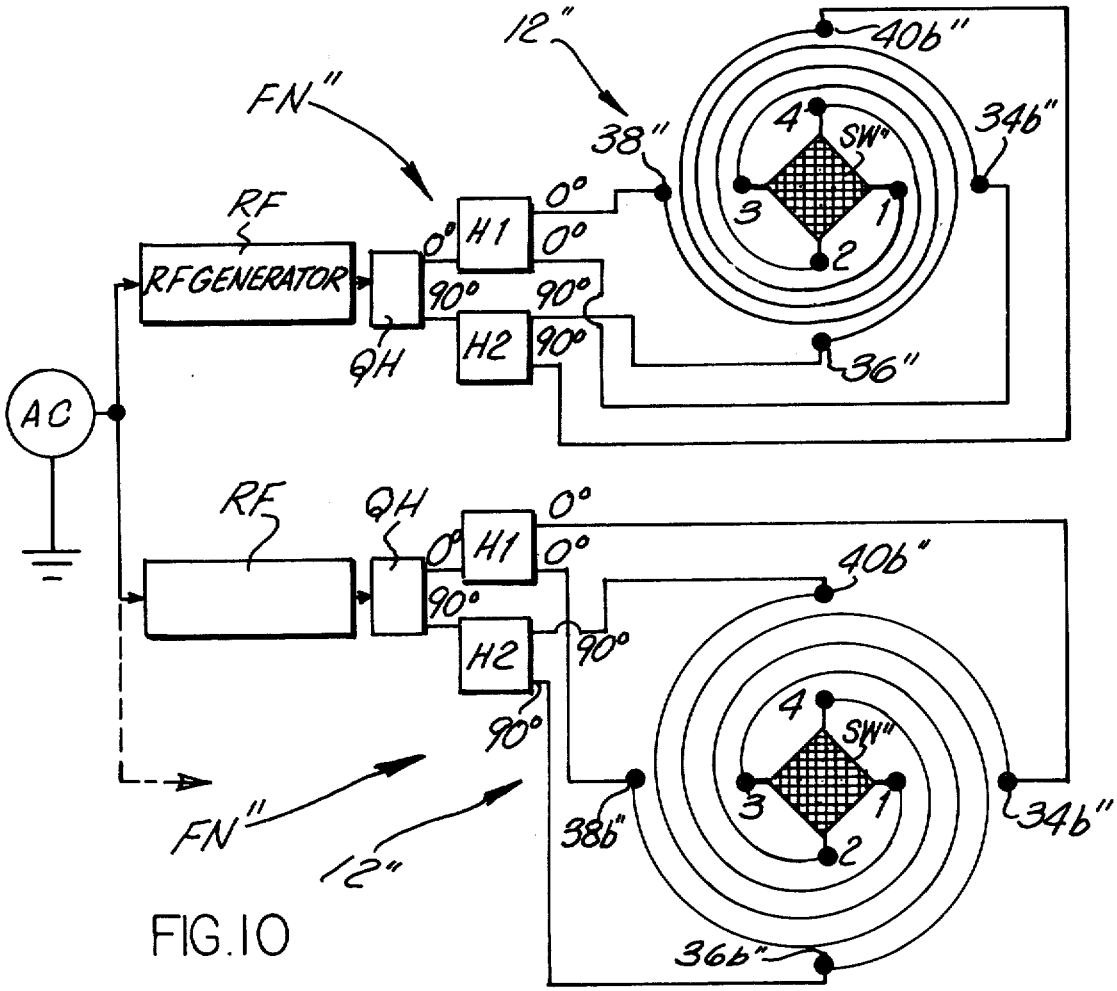

Reference is now made to the embodiment of FIG. 10 which illustrates a feed network FN'' for applying radio frequency energy to the outer arm ends of a plurality of antenna elements constituting an array. For purposes of simplification, only two antenna elements 12'' have been illustrated, it being understood that similar circuitry may be employed for a much greater plurality of antenna elements. This embodiment provides the two bit operation represented by the four phase states illustrated in FIGS. 8A through 8D. Thus, with respect to each antenna element the feed network FN'' respectively supplies radio frequency energy to the outer arm ends 34B'', 36B'', 38B'', and 40B'' with a phase progression of 0°, 90°, 0°, and 90° respectively. As brought out hereinbefore with reference to FIGS. 1 and 3 the cable connections to the outer arm ends of each antenna element is such that the cable lengths are the same and the impedances are the same. The feed network may be comprised of conventional circuitry to obtain the relative phase progression noted above. For example, the feed network FN'' includes for each antenna element a radio frequency generator RF which receives energy from a conventional AC power supply source and then supplies radio frequency energy to a quadrature hybrid circuit QH which, at its output terminals, provides half power energy at two output terminals having a phase progression of 0° and 90°. These outputs are respectfully applied to hybrid circuits H1 and H2 which serve to provide quarter power energy (relative to the energy supplied to the quadrature hybrid circuit QH) and of the same phase as that supplied. Consequently, power at 0° is supplied from the hybrid circuit H1 to the outer arm ends 34B'' and 38B''. The 90° power from hybrid circuit H2 is supplied to the outer arm ends 36B'' and 40B''. The switching circuit SW'' connected to the inner arm ends 1, 2, 3, and 4 is shown schematically in FIG. 10 and is preferably operated in the manner discussed hereinbefore with reference to FIGS. 5 and 6. Thus, to obtain a 0° phase state operation the switching connection provides a short between inner terminals 2 and 3. To obtain a 90° phase state operation the switching circuitry is operated to provide a short circuit between inner terminals 1 and 2. Similarly, to obtain a 180° phase state the switching network is operated to provide a short between inner terminals 1 and 4 and to provide a 270° phase state the switching network is operated to provide a short circuit between inner terminals 3 and 4. This is summarized by the phase state switching configurations illustrated in FIGS. 8A through 8D.

The operation which ensues for a phase condition B mode of operation for the four phase states is tabulated in Tables III, IV, V, and VI reproduced below.

TABLE III

| PHASE CONDITION "B" 0 DEGREES PHASE SHIFT | | | | | |
|---|---|---|---|---|---|
| CURRENT STATE/ INSERTION PHASE | CURRENT FLOW | RELATIVE PHASES OF WINDINGS 1 | 2 | 3 | 4 |
| 1. Current to outer arm ends | In | 0° | 90° | 0° | 90° |
| 2. Insertion phase to active region | In | 0° | 90° | 180° | 270° |
| 3. Currents arrive at active region | In | 0° | 0° | 180° | 180° |
| 4. Insertion phase to inner arm ends | In | 0° | 90° | 180° | 270° |
| 5. Currents arrive at | In | 0° | 90° | 0° | 90° |

TABLE III-continued

| PHASE CONDITION "B" 0 DEGREES PHASE SHIFT | | | | | |
|---|---|---|---|---|---|
| CURRENT STATE/ INSERTION PHASE | CURRENT FLOW | RELATIVE PHASES OF WINDINGS | | | |
| | | 1 | 2 | 3 | 4 |
| inner arm ends | | | | | |
| 6. Current interchange | Out | 0° | 0° | 90° | 90° |
| 7. Insertion phase to active region | Out | 0° | 90° | 180° | 270° |
| 8. Currents arrive at active region | Out | 0° | 90° | 270° | 0° |

TABLE IV

| PHASE CONDITION "B" 90 DEGREES PHASE SHIFT | | | | | |
|---|---|---|---|---|---|
| CURRENT STATE/ INSERTION PHASE | CURRENT FLOW | RELATIVE PHASES OF WINDINGS | | | |
| | | 1 | 2 | 3 | 4 |
| 1. Current to outer arm ends | In | 0° | 90° | 0° | 90° |
| 2. Insertion phase to active region | In | 0° | 90° | 180° | 270° |
| 3. Currents arrive at active region | In | 0° | 0° | 180° | 180° |
| 4. Insertion phase to inner arm ends | In | 0° | 90° | 180° | 270° |
| 5. Currents arrive at inner arm ends | In | 0° | 90° | 0° | 90° |
| 6. Current interchange | Out | 90° | 0° | 0° | 90° |
| 7. Insertion phase to active region | Out | 0° | 90° | 180° | 270° |
| 8. Currents arrive at active region | Out | 90° | 90° | 180° | 0° |

TABLE V

| PHASE CONDITION "B" 180 DEGREES PHASE SHIFT | | | | | |
|---|---|---|---|---|---|
| CURRENT STATE/ INSERTION PHASE | CURRENT FLOW | RELATIVE PHASES OF WINDINGS | | | |
| | | 1 | 2 | 3 | 4 |
| 1. Current to outer arm ends | In | 0° | 90° | 0° | 90° |
| 2. Insertion phase to active region | In | 0° | 90° | 180° | 270° |
| 3. Currents arrive at active region | In | 0° | 0° | 180° | 180° |
| 4. Insertion phase to inner arm ends | In | 0° | 90° | 180° | 270° |
| 5. Currents arrive at inner arm ends | In | 0° | 90° | 0° | 90° |
| 6. Current interchange | Out | 90° | 90° | 0° | 0° |
| 7. Insertion phase to active region | Out | 0° | 90° | 180° | 270° |
| 8. Currents arrive at active region | Out | 90° | 180° | 180° | 270° |

TABLE VI

| PHASE CONDITION "B" 270 DEGREES PHASE SHIFT | | | | | |
|---|---|---|---|---|---|
| CURRENT STATE/ INSERTION PHASE | CURRENT FLOW | RELATIVE PHASES OF WINDINGS | | | |
| | | 1 | 2 | 3 | 4 |
| 1. Current to outer arm ends | In | 0° | 90° | 0° | 90° |
| 2. Insertion phase to active region | In | 0° | 90° | 180° | 270° |
| 3. Currents arrive at active region | In | 0° | 0° | 180° | 180° |
| 4. Insertion phase to inner arm ends | In | 0° | 90° | 180° | 270° |
| 5. Currents arrive at inner arm ends | In | 0° | 90° | 0° | 90° |
| 6. Current interchange | Out | 0° | 90° | 90° | 0° |
| 7. Insertion phase to active region | Out | 0° | 90° | 180° | 270° |
| 8. Currents arrive at active region | Out | 0° | 180° | 270° | 270° |

TABLE VI-continued

| PHASE CONDITION "B" 270 DEGREES PHASE SHIFT | | | | | |
|---|---|---|---|---|---|
| CURRENT STATE/ INSERTION PHASE | CURRENT FLOW | RELATIVE PHASES OF WINDINGS | | | |
| | | 1 | 2 | 3 | 4 |
| active region | | | | | |

Reference is now made to the above Tables III through VI for a discussion of the operation for the phase condition B mode of operation. This is a two bit system in that it provides four phase states of 0°, 90°, 180°, and 270°. For a 0° phase state the switching configuration is operated to obtain a short circuit between inner terminals 2 and 3 in accordance with FIG. 8A. The feed network FN'' supplies radio frequency energy to the outer arm ends with a phase progression of 0°, 90°, 0°, and 90° on arm ends 34B'', 36B'', 38B'', and 40B'' respectively. As was brought out hereinbefore the insertion phase from the outer arm ends to the active region is a phase progression of 0°, 90°, 180°, and 270° on windings 1, 2, 3, and 4 respectively. Consequently then, the currents arrive at the active region out of phase with a phase progression of 0°, 0°, 180°, and 180°. This phase relationship prevents radiation of energy. The currents then continue to flow inwardly toward the inner arm ends and arrive at the inner arm ends with a phase progression 0°, 90°, 0°, and 90° on windings 1, 2, 3, and 4 respectively. Since inner terminals 2 and 3 are shorted together current swapping takes place on windings 2 and 3 and, hence, the currents commence to flow outwardly from the inner terminals with a phase progression of 0°, 0°, 90°, and 90° on windings 1, 2, 3, and 4 respectively. The insertion phase to the active region is 0°, 90°, 180°, and 270° and the currents arrive at the active region with a phase progression of 0°, 90°, 270°, and 0°. It will be noted that there are two in-phase windings and two out of phase windings. The currents in the out of phase windings 2 and 3 cancel and the in-phase currents in windings 1 and 4 are additive and provide efficient radiation at a relative phase of 0°.

Figure 8A:
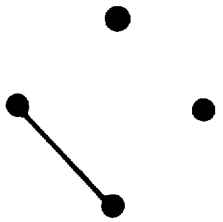
FIGS. 8A through 8D are graphical illustrations of switching configurations.
Figure 8B:
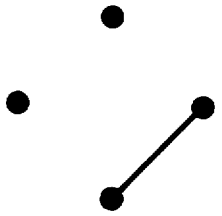

The operation which ensues for a 90° phase shift is tabulated in Table IV. This requires that the switching configuration follow that as indicated in FIG. 8B wherein inner terminals 1 and 2 are shorted together. As indicated in Table IV the operation is the same as that for a 0° phase shift for steps 1 through 5. Since terminals 1 and 2 are shorted together the currents in those windings will interchange and, hence, current will initially flow outwardly from the inner terminals with a phase progression of 90°, 0°, and 90° on windings 1, 2, 3, and 4 respectively. Consequently then, the currents will arrive at the active region with a phase progression of 90°, 90°, 180°, and 0°. The currents in windings 3 and 4 cancel and the currents in windings 1 and 2 are in-phase and will add resulting in efficient radiation of electromagnetic energy with a 90° phase shift.

Figure 8C:
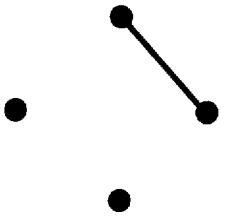

The operation that ensues for a 180° phase shift for phase condition B mode is tabulated in Table V. For this operation the switch configuration is operated so as to obtain a short circuit between inner terminals 1 and 4 as indicated by FIG. 8C. The operation that ensues is the same for steps 1 through 5 as that discussed hereinbefore with reference to the 0° phase state and the 90° phase state. However, with inner terminals 1 and 4 shorted together the currents in arms 1 and 4 interchange and the currents will initially flow outwardly along the arms with a phase progression of 90°, 90°, 0°, and 0° windings 1, 2, 3, and 4 respectively. These currents then will arrive at the active region with a phase progression of 90°, 180°, 180°, and 270°. The currents in windings 1 and 4 will cancel and the currents in windings 2 and 3 will add resulting in efficient radiation with a relative phase shift of 180°.

Figure 8D:
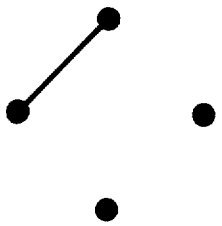

The operation that ensues for a 270° phase state for phase condition B mode is tabulated in Table VI. In this phase state inner terminals 3 and 4 are shorted together as indicated in FIG. 8D. The operation for the first five steps in Table VI is the same as that discussed hereinbefore with reference to the 0° phase state, the 90° phase state, and the 180° phase state. However, with terminals 3 and 4 shorted together the currents in the windings 3 and 4 will interchange and the currents will initially flow outwardly with a phase progression of 0°, 90°, 90° and 0° respectively. These currents then will arrive at the active region with a phase progression of 0°, 180°, 270°, and 270° on windings 1, 2, 3, and 4 respectively. The currents on windings 1 and 2 will cancel and the currents on windings 3 and 4 will reinforce each other to provide efficient radiation with a relative phase shift of 270°.

Whereas the invention has been described with respect to preferred embodiments it is appreciated that various modifications and arrangements may be made within the spirit and scope of the appended claims.

What is claimed is:

1. An element antenna comprising:

A plurality of electrically conductive spiral arms spaced from each other and having a common axis of rotation, each said arm having inner and outer ends, said inner ends being rotational displaced about said axis relative to each other by a given angle to achieve a given rotational phase progression about said common axis;

each of said arms being of a length sufficient that each arm intersects an annular active region essentially coaxial about said common axis and at which electromagnetic energy is efficiently radiated from the antenna element by currents flowing in the respective arms in the same direction and in-phase as they arrive at the active region;

phase control means for effectively electrically rotating said spiral arms about said axis to control the phase relationship of electromagnetic energy to be radiated from said element antenna comprising means for interconnecting at least one pair of inner arm ends together to effectively obtain a short circuit therebetween so that electrical signals in the respectively interconnected pair of arms are interchanged from one arm to the other with a relative phase change dependent upon the rotational phase relationship between the interconnected inner arm ends; and, feed means directly connected only to the outer arm ends of said arms for feeding radio frequency energy from a feed source to each arm to cause current to flow in each arm from the outer end thereof toward the inner end thereof, said feed means including means for feeding energy to said outer arm ends such that the currents in said respective arm ends initially flow from the outer arm ends toward the inner arm ends with a phase progression relative to each other so that as the respective inwardly flowing currents enter the active region they are out of phase, preventing efficient radiation from the antenna element.

2. An element antenna as set forth in claim 1, wherein said feed means includes a plurality of conductors of equal length and impedance each interconnecting a respective one of said outer arm ends and a said feed source.

3. An element antenna as set forth in claim 1, wherein said antenna element includes four spiral arms with said inner arm ends being rotationally displaced about said axis by 90° from each other to achieve a relative phase progression of 0°, 90°, 180°, and 270°.

4. An element antenna as set forth in claim 3, wherein said arms are configured in such a manner and said feed means supplies currents to said outer arm ends in such a manner that the inwardly flowing currents in said respective arms initially enter said active region with a relative out of phase progression of 0°, 180°, 0°, and 180°.

5. An element antenna as set forth in claim 4, wherein the insertion phase from said outer arm ends to said active region for said respective arms is 0°, 90°, 180° and 270°.

6. An element antenna as set forth in claim 4, wherein said feed means feeds currents to said outer arm ends with a respective phase progression of 0°, 270°, 180°, and 90° so that said currents on said different arms initially arrive at said active zone out of phase with a relative phase progression on said respective arms of 0°, 180°, 0°, and 180°.

7. An element antenna as set forth in claim 3, wherein said arms are configured in such a manner and said feed means supplies currents to said outer arm ends in such a manner that the inwardly flowing currents in said respective arms initially enter said active region with a relative out of phase progression of 0°, 0°, 180°, and 180°.

8. An element antenna as set forth in claim 7, wherein the insertion phase from said outer arm ends to said active region for said respective arms is 0°, 90°, 180°, and 270°.

9. An element antenna as set forth in claim 7, wherein said feed means feeds currents to said outer arm ends with a respective phase progression of 0°, 90°, 0°, and 90° so that said currents on said different arms initially arrive at said active zone out of phase with a relative phase progression on said respective arms of 0°, 0°, 180°, and 180°.

10. An element antenna as set forth in claim 9, wherein the insertion phase from said active region to said inner arm ends for said respective arms is 0°, 90°, 180°, and 270°.

* * * * *